United States Patent [19]

Ebata

[11] 4,445,450

[45] May 1, 1984

[54] SWITCHING DEVICE OF DUAL FUNCTION SEWING MACHINE

[75] Inventor: Yoshikazu Ebata, Tokyo, Japan

[73] Assignee: Janome Sewing Machine Co., Ltd., Tokyo, Japan

[21] Appl. No.: 402,815

[22] Filed: Jul. 28, 1982

[30] Foreign Application Priority Data

Aug. 5, 1981 [JP] Japan ..... 56-121889

[51] Int. Cl.[3] ..... D05B 25/00

[52] U.S. Cl. ..... 112/155; 112/168

[58] Field of Search ..... 112/155, 168

[56] References Cited

U.S. PATENT DOCUMENTS 4,267,786 5/1981 Hanyu et al. ..... 112/168

4,343,250 8/1982 Hanyu et al. ..... 112/168

FOREIGN PATENT DOCUMENTS 2901139 12/1979 Fed. Rep. of Germany ..... 112/155

*Primary Examiner*—Werner H. Schroeder

*Assistant Examiner*—Andrew M. Falik

*Attorney, Agent, or Firm*—Michael J. Striker

[57] ABSTRACT

In a double-function sewing machine including a lock stitching mechanism and an overlock stitching mechanism a common driving source and a common flywheel for both stitching mechanisms are used. A switching device for switching the sewing machine from operation with the overlock stitching mechanism to the operation with lock stitching mechanism and vice versa is provided in the sewing machine. This device includes a belt wheel bush rotatable with respect to the machine frame and driven by the driving source and secured to the shaft of the flywheel, a belt wheel for overlock stitching rotatably supported with respect to the machine frame and connected to the overlock stitch forming mechanism, a ratchet guide member mounted on the main shaft of the lock stitch-forming mechanism and pivoted with respect to the machine frame, two sliding plates one of which is the mounted on ratchet guide member and another one of which is mounted on the belt wheel, and a switching lever. The switching lever is operated to alternatively hold one of the sliding plates on the belt wheel bush for selecting for operation the lock stitch-forming mechanism or the overlock stitch-forming mechanism.

6 Claims, 12 Drawing Figures

SWITCHING DEVICE OF DUAL FUNCTION SEWING MACHINE

BACKGROUND OF THE INVENTION

Double-function sewing machines including a lock stitching mechanism and an overlock stitching mechanism have been known in the art.

In the mass production of sewn clothes, the lock stitches and the overlock stitches are most used. The lock stitching device and the overlock stitching device for producing stitches are normally mounted on a single machine frame and are driven by a common driving member. These devices have, respectively, their own needles, feeding teeth, needle plates and thread taking levers.

However, the conventional double-function sewing machines have not been provided with any arrangement for preventing switching between the lock stitching function and the overlock stitching function when the sewing machine is in operation.

SUMMARY OF THE INVENTION

It is an object of the invention to avoid disadvantages of conventional sewing machines.

It is another object of the invention to provide a sewing machine in which a common driving source and a common flywheel are used for both stitching mechanisms.

A further object of the invention is to perform and ensure switching between these two stitching mechanisms only when the sewing machine is inoperative in order to avoid erroneous switching operation during driving of the sewing machine. The switching operation in the present sewing machine is manually carried out to avoid risk that a main shaft of a stitch forming mechanism, which has not been selected, is rotated less than one revolution after it has been switched over and to avoid risk of a shock to the mechanism at switching, and to avoid risk of slipping of the upper thread of the non-selected mechanism at switching.

Still another object of the invention is to securely connect the selected stitch-forming mechanism to a driving source and to disconnect the non-selected stitch-forming mechanism from the driving source, and at the same time to ensure switching for providing safety during operation.

Yet another object of the invention is to provide driving forwards and backwards of the selected stitch-forming mechanism not only by the driving source but also by a manual operation of the flywheel, thereby to enable adjustment by the manual operation of the flywheel, if necessary.

A further object of the invention is to provide stopping of the selected stitch-forming mechanism together with the flywheel, so that the stitching operation may be carried out under desirable condition.

These and other objects of the invention are attained by a switching device of a double-function sewing machine of the type including a machine frame, a flywheel having a shaft, a lock stitch forming mechanism having a main shaft and an overlock stitch forming mechanism, the device comprising a belt wheel bush which is rotatable with respect to the machine frame and is driven by a driving source, said belt wheel bush having an end secured to the shaft of the flywheel; a ratchet guide member mounted on the main shaft of the lock stitch forming mechanism, said guide member being pivoted with respect to the machine frame; a first sliding plate mounted on said ratchet guide member; a belt wheel for overlock stitching rotatably supported with respect to the machine frame and operatively connected to the overlock stitch forming mechanism; a second sliding plate mounted on said belt wheel; a switch lever which is operated from outside of the machine frame; and a pair of switching arms operatively connected to said switch lever and operated thereby such that said first sliding plate and said second sliding plate are alternatively held on said belt wheel bush for selecting the lock stitch forming mechanism or the overlock stitching forming mechanism.

DETAILED DESCRIPTION OF THE DRAWINGS

FIGS. 2 and 3 are views illustrating a selecting condition of an overlock stitch forming mechanism, in which FIG. 2 is a lengthwise view of a main part of a switching device, and FIG. 3 is a sectional view of the above but illustrating some parts not shown in FIG. 2;

Figure 7:
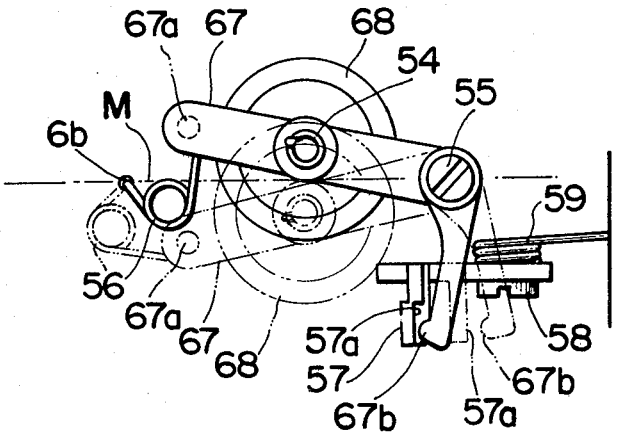
FIG. 7 is a view showing a part of a thread winding mechanism as seen from an arrow A in FIG. 2.
Figure 8:
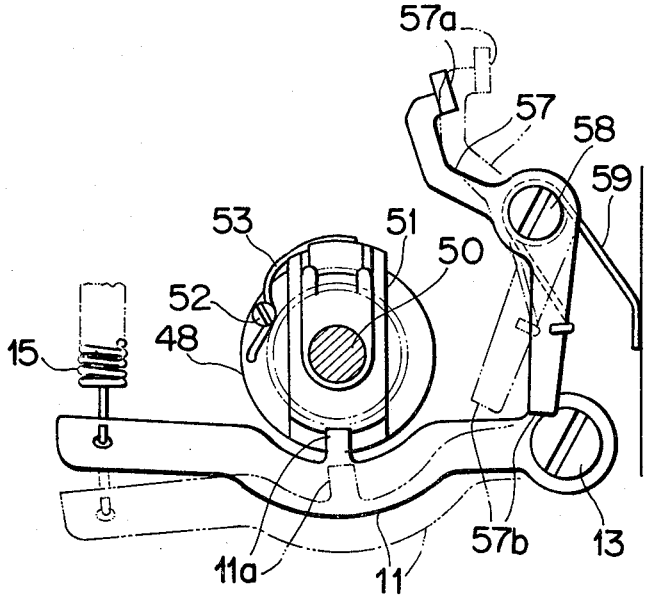
FIG. 8 is a view of a main part as seen from an arrow B—B in FIG. 2.
Figure 9:
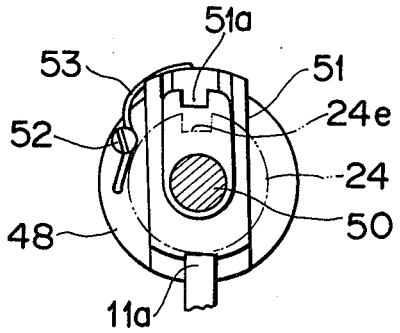
Figure 10:
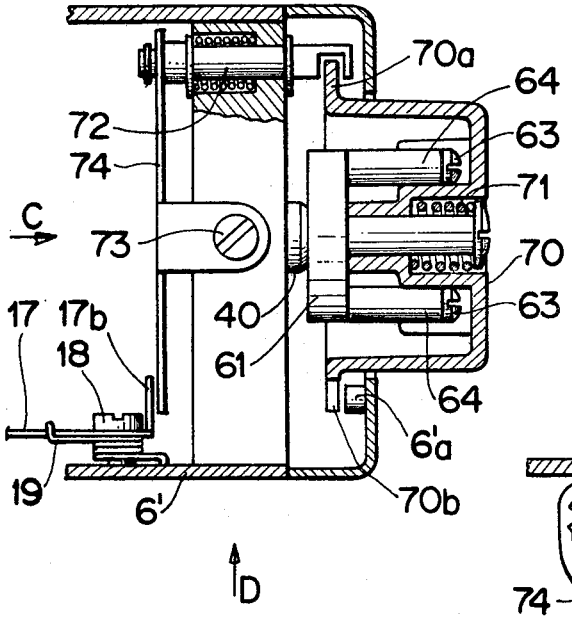
Figure 11:
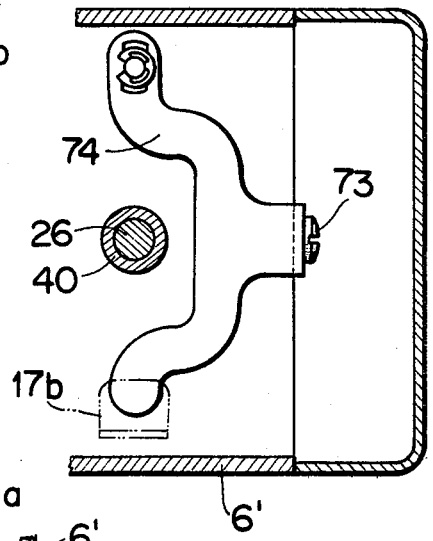
Figure 12:
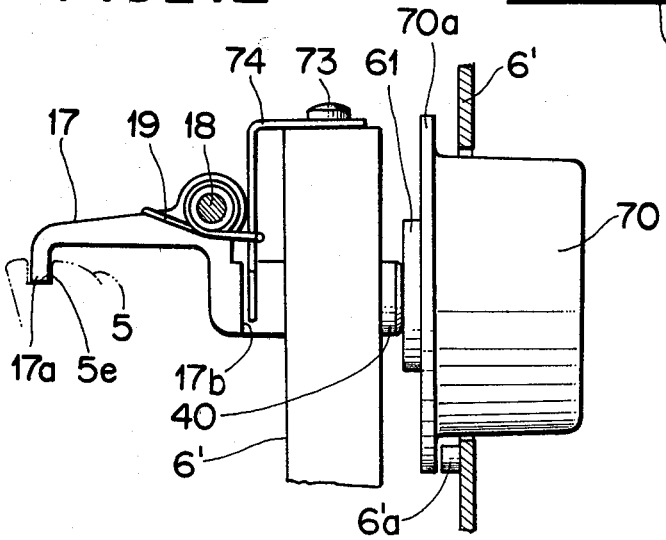

FIG. 9 is a view showing an engaging mechanism at the lock-stitching side, which is other than the engaging mechanism between the bush of a belt wheel and a ratchet of a sliding plate, shown in FIGS. 1 to 8; and FIGS. 10 to 12 show embodiments of a pulling system of a flywheel, different from a pushing system of the flywheel shown in FIGS. 1 to 8, in which FIG. 10 is a lateral cross sectional view showing relation between the flywheel and a safety lever, FIG. 11 is a cross sectional view seen from an arrow C in FIG. 10, and FIG. 12 is a cross sectional view seen from an arrow D in FIG. 10.

DETAILED DESCRIPTION OF THE PREFERRED EMBODIMENTS

Figure 1:
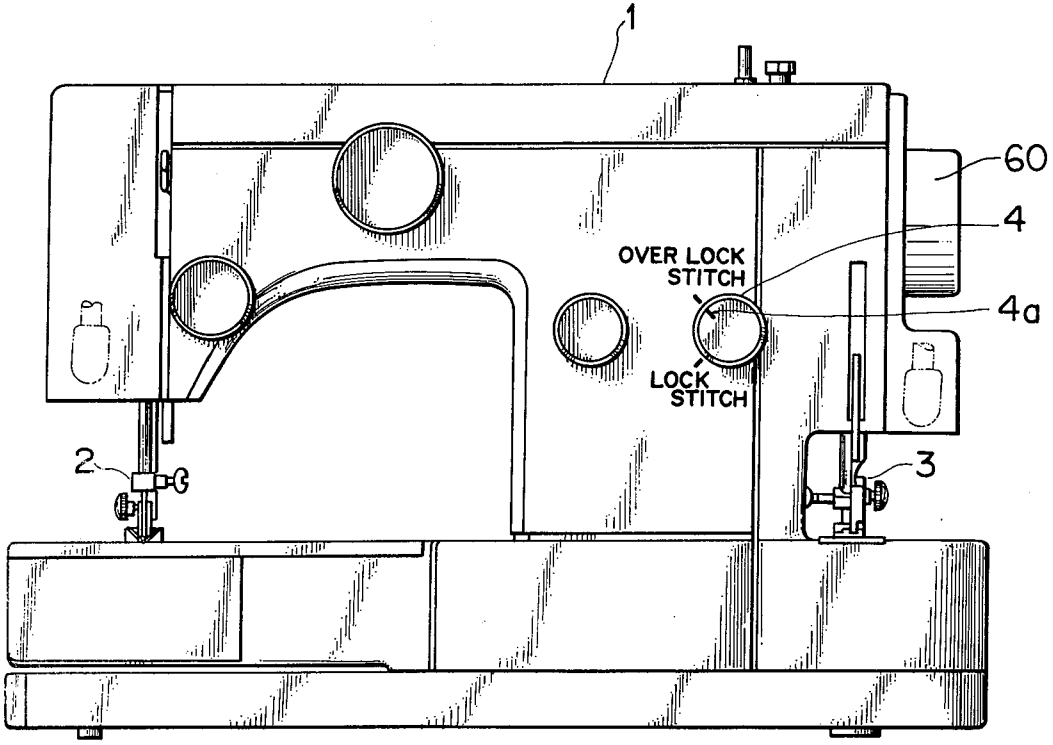
FIG. 1 is a side view of a double-function sewing machine.

The present invention will be explained in reference to the illustrated embodiments. In FIG. 1, the reference numeral 1 is a double-function sewing machine, 2 is a stitching part of the lock stitch forming mechanism (called as "lock stitching mechanism" hereafter), and 3 is a stitching part of the overlock stitch forming mechanism (called as "overlock stitching mechanism" hereafter). These stitching mechanisms are selectively driven as later mentioned by one driving motor (not shown) via transmission mechanism and clutch mechanism, through operation of a switching dial 4. The numeral **4*a* refers to the switching dial 4**.

Main parts of the device of the invention will be explained with reference to FIGS. 2 to 6. A shaft **5*a* of a switch lever 5 passes through a machine frame 6, a projecting part of which is fixed with the switching dial 4 by screws 7. The switching dial 4 is regulated with respect to rotation via a pin 4b by means of a regulating plate 9 secured to the frame 6 by screws 8**.

The switch lever 5 is defined at its segment 5b with grooves 5c and 5d, and with switch actuating lugs 5e and 5f on its outside and with a hole 5h in an extension 5g. The numeral 10 is a dial spring, one end of which is engaged in the hole 5h and the other end of which is in a hole 6a formed in the machine frame 6. When the hole 5h is positioned leftwards of a line L (FIG. 2) combining a center of the shaft 5a and the hole 6a, the switch lever 5 is biased in the clockwise direction around the shaft 5a in FIG. 2, and on the other hand when it is positioned rightwards of the line L, the switch lever 5 is biased in the counterclockwise direction.

The numerals 11 and 12 are switching arms which are defined with projections 11a and 12a respectively one, of the ends of which are pivoted on stepped screws 13 and 14 and which are biased in the clockwise direction around the stepped screws 13 and 14 by means of springs 15 and 16 between the machine frame 6 and the holes 11b, 12b in arms 11 and 12, respectively. Upper ends 11c and 12c thereof are positioned within moving loci of the actuating lugs 5e and 5f of the switch lever 5.

Figure 2:
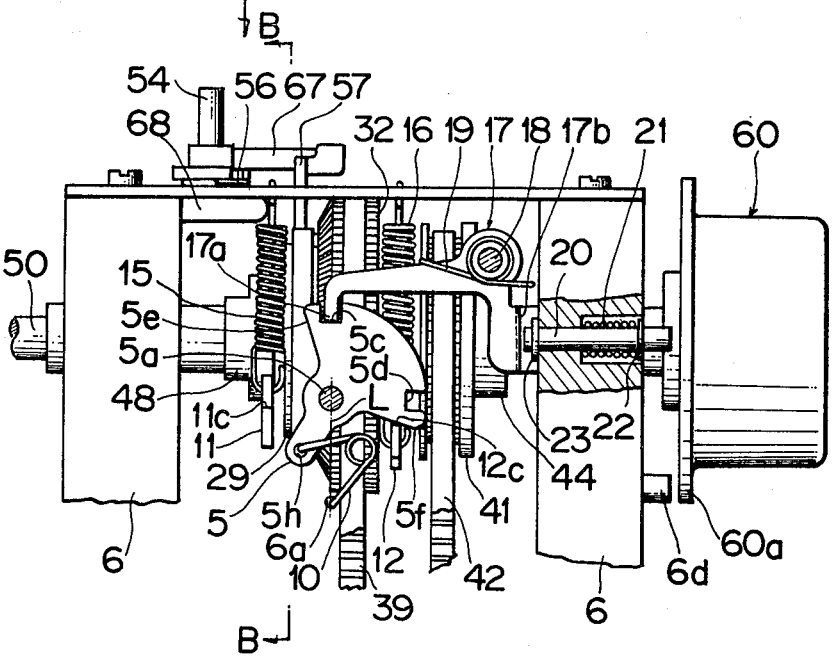

The numeral 17 is a safety lever which is pivoted on a stepped screw 18 secured to the machine frame 6, and is biased to the counterclockwise direction in FIG. 2 by a spring 19. An end portion 17a thereof alternatively engages one of grooves 5c and 5d of the switch lever 5. The other end portion is defined with a projection 17b. The numeral 20 is a release shaft of the safety lever 17, which is slidably held to the machine frame 6, and is biased toward the right side in FIG. 2 via a thrust ring 22 and is positioned by the thrust ring 23 with respect to the machine frame 6.

The numeral 24 is a belt wheel bush. A main body 24a thereof (FIG. 5) is formed with screw holes 24b penetrating thereinto, and is formed at its both sides with ratchet wheels 24g and 24h having ratchet gears 24e and 24f. The bush 24 is secured to a shaft 26 of the flywheel by a screw 25. The bush 24 is formed with declutch seats 24d on an outer circumference 24c, and is fixedly mounted on shaft 26 with a washer 29 planted with a pin 29a via a washer 27 and a spring receipt 28, by a screw 30.

A clutch lever 31 is defined with a hole 31a and a projection 31b, and is provided with a guide portion 31d having a guide hole 31c, and is pivoted on a pin 29a of the washer 29 via the hole 31a.

The belt wheel bush 24 has mounted on its outer circumference 24c (shown in FIG. 5) a belt wheel 32 via its inner circumference 32a. The clutch lever 31 is biased toward such a direction that the projection 31b separates from a face 28a of the spring receipt 28 around the pin 29a of the washer 29 by a coil spring 33 held between the clutch lever 31 and the spring receipt 28. A guide portion 31d entering between the declutch seat 24d and the inner circumference 32a guides, due to the guide hole 31c, a roller 34 to a narrower space between an auxiliary plate 35 mounted on the declutch seats 24d and the inner circumference 32a. The washer 36 is fitted with the outer circumference 24c and the declutch seats 24d of the bush 24 on its inner circumference 36a by means of the washer 38 secured to the bush 24 by a screw 37. The washer 36 contacts the belt wheel 32 to regulate the belt wheel 32 in the axial direction with respect to the bush 24 together with the washer 27.

The belt wheel 32 is formed with a knurled portion 32c and a belt gear 32d, and is connected to a motor (not shown) as the driving source via a belt 39 on the belt gear 32d. The numeral 40 is a bearing tube fixed to the machine frame 6 and mounted with a wheel shaft 26 therein.

The numeral 41 is a belt wheel which is mounted on the outer circumference 40a of a bearing tube 40 and is connected to the overlock stitching mechanism via the belt 42 wound on the belt gear 41a. The belt wheel 41 is defined with a ratchet guide 41g which is provided with a guide groove 41b, a groove 41c, a hole 41d and a screw hole 41e. The belt wheel 41 is regulated in the axial position by a ring 44 fixed to the bearing tube 40 by a screw 43, and the side 41f of belt wheel 41 partially slides on the side 24l of the bush 24 of the belt wheel.

The numeral 45 is a ratchet pawl which is a sliding plate and is formed with a pawl 45a, and groove 45b, a groove 45c for passing a a shaft 26 of the flywheel therethrough, and a groove 45d for catching a spring 47. The ratchet pawl 45 is guided between a side 24l and the guide groove 41b under a condition that the shaft 26 of the flywheel passes through the groove 45c, and is biased by spring 47 via the groove 45d to a direction that the pawl 45a engages a ratchet gear 24f of the belt wheel bush 24. The spring 47 is inserted at its one end into a hole 41d of the belt wheel 41 and is held at its center by a screw 46 screwed into a screw hole 41e.

The numeral 48 is a ratchet guide member which is formed with a guide groove 48a, a groove 48b, a hole 48c and a screw hole 48d, and is fixed by a screw 48e to a main shaft 50 of the lock stitching mechanism, and an end 48e thereof partially slides on an end 24k of the belt wheel bush 24.

The numeral 51 is a ratchet pawl which is a sliding plate and is formed with a pawl 51a, a groove 51b, a groove 51c for passing a main shaft 50 therethrough, and a groove 51d for catching a spring 52. The ratchet pawl 51 is guided between the end 24k and the guide groove 48a under a condition that the main shaft 50 passes through the groove 51c and is biased by spring 52 via the groove 51d to such a direction that the pawl 51a engages a ratchet gear 24e of the belt wheel bush 24. The spring 52 is inserted at one end into a hole 48c of the ratchet guide member 48 and is held at its center by a screw 52 screwed into a screw hole 48d.

Figure 4:
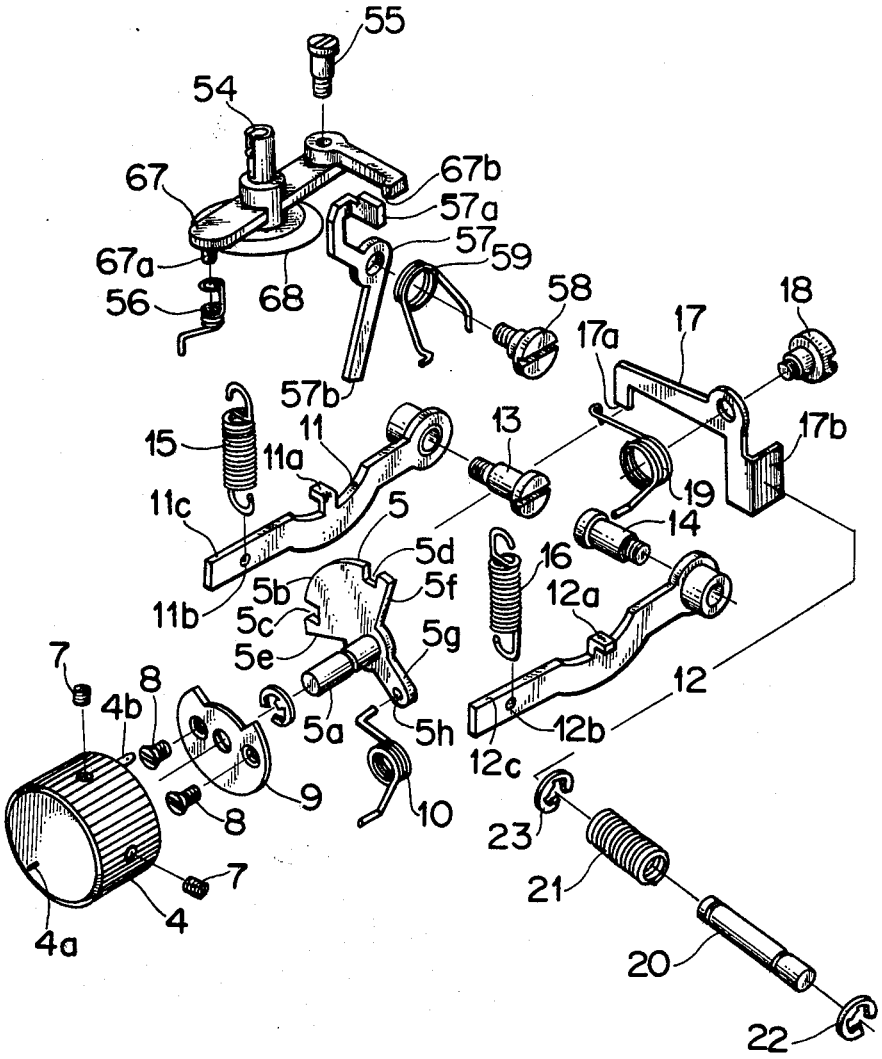
FIG. 4 is an exploded perspective view of the main part of the switching device.
Figure 5:
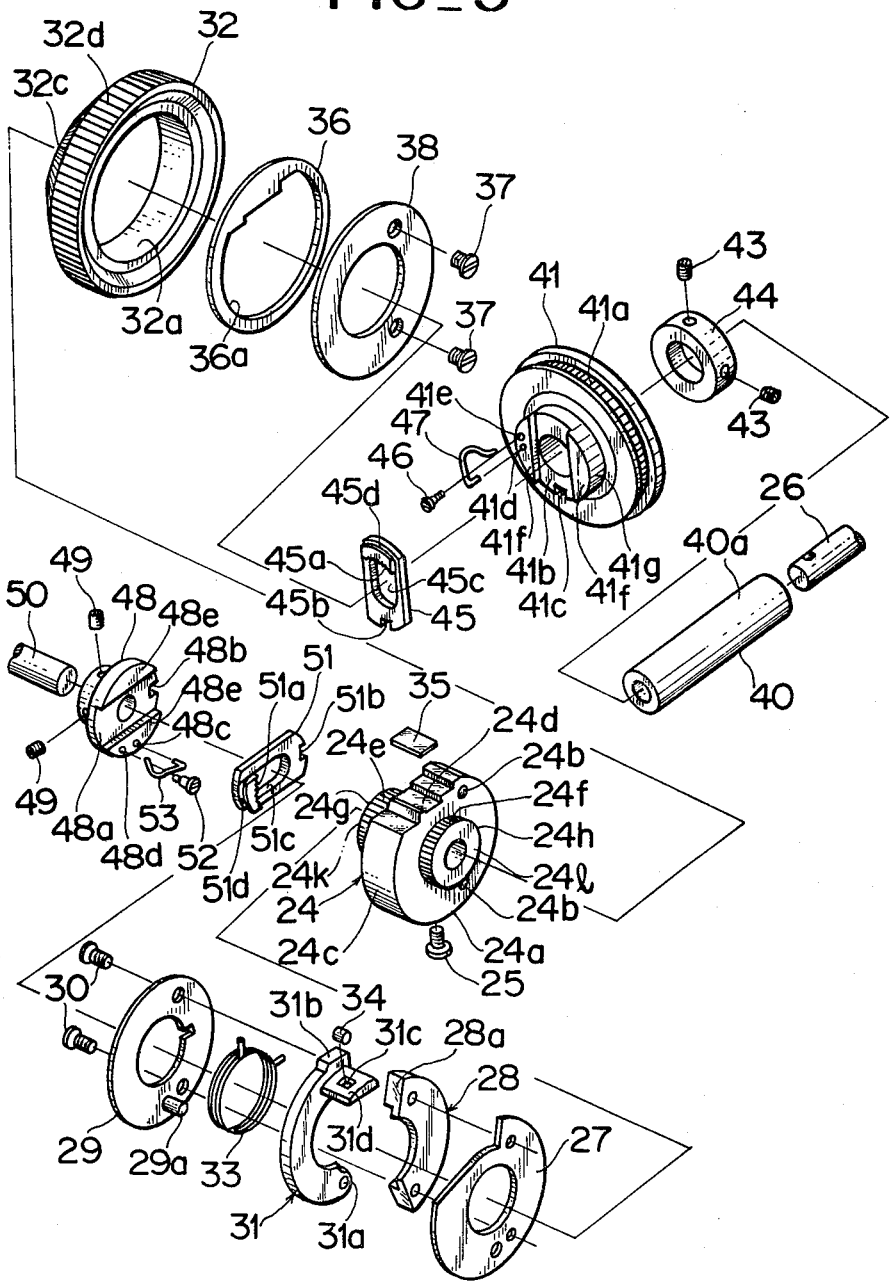
FIG. 5 is an exploded view of the main part illustrating the parts not shown in FIG. 4.
Figure 6:
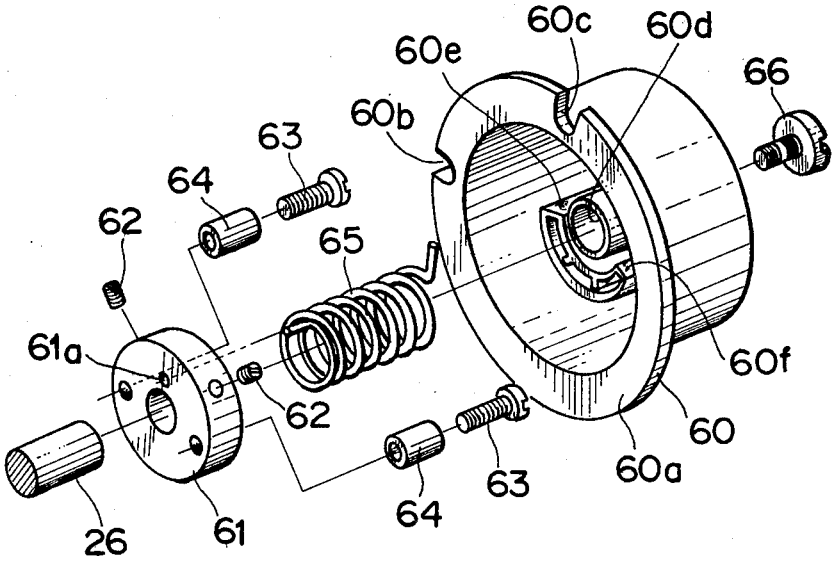
FIG. 6 is an exploded perspective view of the main part of the switching device but illustrating parts not shown in FIGS. 4 and 5.

The projections 11a and 12a of the switch arms 11 and 12 are biased to the clockwise direction in FIG. 4 by the springs 15 and 16, and alternatively engage both the groove 48b and the groove 51b, or both the groove 41c and the groove 45b.

A thread winding arm 67 (FIGS. 2 and 4) rotatably holds a thread winding shaft 54 secured to a thread winding rubber disc 68, and is pivoted on a stepped screw 55 furnished to the machine frame 6. A spring 56 is engaged between a hole 6b formed in the machine frame 6 and a pin 67a of the thread winding arm 67. When the pin 67a is in FIG. 7 positioned above the line M combining the center of the stepped screw 55 and the hole 6b, it biases the thread winding arm 67 around the screw 55 to the clockwise direction, and on the other hand when the pin 67a is positioned under the line M, it biases the thread winding arm 67 around the screw 55 to the counterclockwise direction.

A declutch arm 57 is pivoted on a stepped screw 58 furnished to the machine frame 6, and is biased around the screw 58 to the clockwise direction in FIG. 8 by a spring 59 betweeen the declutch arm 57 and the machine frame 6. When the thread is not wound, that is, when the thread winding arm 67 is positioned at the solid line in FIG. 7, an engaging face 57*a* of the declutch arm 57 is contacted with a horn 67*b* of the thread winding arm 67 so that the thread winding arm 67 is positioned at the solid line in FIGS. 7 and 8. When the thread is wound, that is, when the thread winding arm 67 is at the broken line, the horn 67*b* is separated from the engaging face 57*a*, the declutch arm 57 enters at its lower end portion the moving loci of the projection 31*b* of the clutch lever 31.

The numeral 60 is the flywheel which is formed with one or a plurality of grooves (two grooves 60*b* and 60*c* in the present embodiments) in a flange portion 60*a*, and hole portion 60*d* which is mounted on a shaft 26 of the flywheel. The flywheel 26 is inserted into the bearing tube 40 fixed to the machine frame 6. The numeral 61 is a ring which is fixed to the flywheel shaft 26 by a screw 62. A couple of collars 64 fixed to the ring 61 by screws 63 are to be attached at outer circumferences to inner walls 60*e* and 60*f* of the flywheel 60, whereby the ring 61 and the flywheel 60 are made integral in the rotation direction. A spring 65 is arranged between the ring 61 and an inner side of the flywheel 60, and biases the flywheel 60 rightwards in FIG. 3, and operates between the hole 61*a* of the ring 61 and an engaging part (not shown) at the inner face of the flywheel, so that the spring 65 absorbs rattling in the rotation direction between the collars 64 and the inner walls 60*e*, 60*f*. The numeral 66 is a screw urged into the flywheel shaft 26 to check the flywheel 60 biased rightwards in FIG. 3 by the spring 65.

Figure 3:
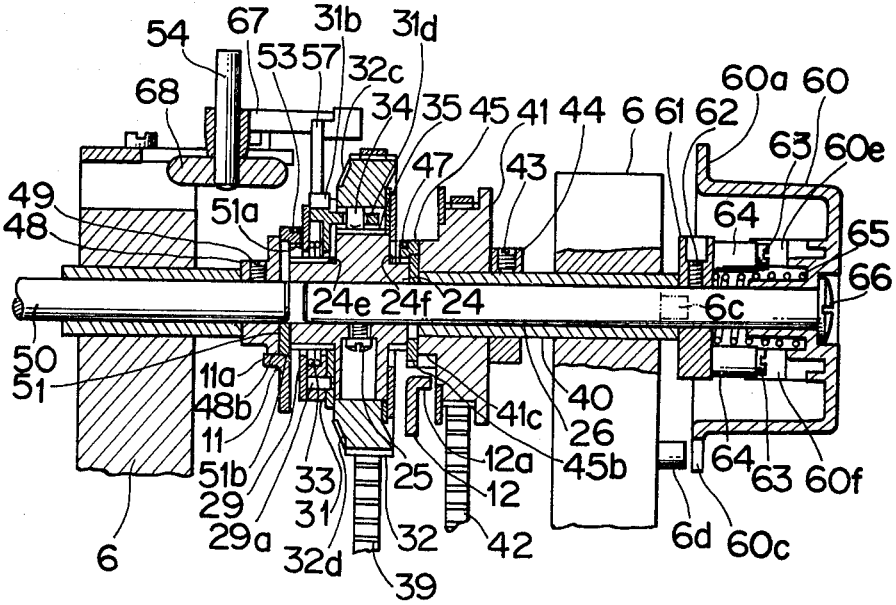

From the machine frame 6, two pins 6*c* and 6*d* (as shown in FIG. 3) are extended to two grooves 60*b* and 60*c* of the flywheel 60, and the flywheel 60 is rotated by the manual operation when the sewing machine is stopped so that the grooves 60*b* and 60*c* can mesh with the the pins 6*c* and 6*d* and the flywheel can be urged to the machine frame until the flange 60*a* contacts the machine frame 6. This is switch phase of the flywheel.

The projections 11*a* and 12*a* of the switch arms 11 and 12 alternatively engage both the grooves 48*b* and 51*b*, and both the grooves 41*c* and 45*c*. During rotating the flywheel 60 by the manual operation to meet the switch phase, the engaged stitching mechanism is not actuated with rotation of the flywheel 60 and is engaged with the projection of the switch arm, and the non engaged stitching mechanism is actuated with rotation of the flywheel 60 and is switched to the switch phase.

Actuation of the mechanism of the invention will be explained below. FIGS. 2 and 3 illustrate selection of the overlock stitching mechanism. The end portion 17*a* of the safety lever 17 engages the groove 5*c* of the switch lever 5, and the actuating lug 5*f* pushes up the upper end 12*c* of the switch arm 12 against the action of the spring 16, and the projection 12*a* of the switch arm 12 is released from the groove of the ratchet pawl 45 and the groove 41*c* of the belt wheel 41, and the pawl 45*a* of the ratchet pawl 45 is engaged with the ratchet gear 24*f* of the belt wheel bush 24 by action of the spring 47. When the belt wheel bush 24 is rotated by the driving source via the belt 39, the belt wheel 32 and the collar 34, the overlock stitching mechanism is driven via the ratchet pawl 45, the belt wheel 41 and the belt 42.

Since the actuating lug 5*e* of the switch lever 5 does not engage the upper end 11*c* of the switch arm under selection of the overlock stitching mechanism, the projection 11*a* is biased upwardly by the spring 15 and engages the groove 48*b* of the ratchet pawl, guide member 48 and the groove 51*b* of the ratchet pawl 51. Since the projection 11*a* is guided in the groove 48*b* and holds the pawl 51*a* against the action of the spring 53 apart from the ratchet gear 24*e*, the rotation of the belt wheel bush 24 is not transmitted to the ratchet pawl 51 and the ratchet pawl guide member 48, and since these members are engaged by the projection 11*a* of switch arm 11 in the rotation direction, the lock stitching mechanism connected to the main shaft 50 is held under the stopping condition. Therefore, the non-selected lock stitching mechanism is never driven so far as the overlock stitching mechanism is selected.

With respect to switching of the overlock stitching mechanism to the selection of the lock stitching mechanism it is understood that, when the flywheel 60 is rotated by the manual pushing operation in the axial direction while the sewing machine is stopped, the grooves 60*b* and 60*c* of the flywheel 60 coincide with the phases of the pins 6*c* and 6*d*. This is the switch phase of the flywheel. By rotation of the flywheel 60 until reaching this phase, the belt wheel bush 24 secured on the flywheel shaft 26 rotates the ratchet pawl 45 and the belt wheel 41 so that the grooves 45*b* and 41*c* thereof move them to the rotation phase in which they are engageable with the projection 12*a* of the switch arm 12. If the flywheel 60 is urged in the axial direction, the pins 6*c* and 6*d* enter the grooves 60*b* and 60*c* of the flange 60*a*, so that the flywheel 60 is restricted in rotation, and at the same time the flange portion 60*a* pushes the bent portion 17*b* of the safety lever 17 via the releasing shaft 20, and the safety lever 17 is rotated around the stepped screw 18 in the counterclockwise direction in FIG. 2, and the end portion 17*a* is released from the groove 5*c* of the switch lever 5, and the switch lever 5 is made rotatable. Under this condition, the switch dial 4 is rotated to the counterclockwise direction from the condition in FIG. 1 to switch the indication line 4*a* from OVERLOCK STITCH TO LOCK STITCH, and if the flywheel 60 is released from pushing, the flywheel 60 returns to the position where it is engaged with the spring 66 by the spring 65, and the releasing shaft 20 returns to the original position by the spring 21, and the safety lever 17 rotates around the stepped screw 18 to the counterclockwise direction by action of the spring 19, and the end portion 17*a* engages the groove 5*d* of the switch lever 5. Thus the switch to the lock stitch is finished.

Under selection of the lock stitching mechanism, the actuating lug 5*e* of the switch lever 5 pushes down the upper face 11*c* of the switch arm 11 against action of the spring 15, and the projection 11*a* of the switch arm 11 moves away from the groove 48*b* of the ratchet guide member 48 and the groove 51*b* of the ratchet pawl 51, and the pawl 51*a* of the ratchet pawl 51 is engaged with the ratchet gear 24*e* of the belt wheel bush 24 due to action of the spring 53. When the belt wheel bush 24 is rotated by the driving source via the belt 39, the belt wheel 32 the roller 34, and the main shaft 50 are rotated. The latter is connected to the belt wheel bush via the ratchet pawl 51 and the ratchet pawl guide member 48.

Under selection of the lock stitching mechanism, since the actuating lug 5*f* of the switch lever 5 does not actuate the upper end 12*c* of the switch arm 12, the projection 12*a* of the switch arm 12 is pushed up by the spring 16 and engages the groove 41*c* of the belt wheel 41 and the groove 45*b* of the ratchet pawl 45. Since the actuating lug 5*f* is guided in the groove 41*c* and maintains the pawl 45*a* apart from the ratchet gear 24*f* against the action of the spring, the rotation is not transmitted to the ratchet pawl 45 and the belt wheel 41, and since these members are engaged in the rotation direction, the overlock stitching mechanism is maintained stopped and connected to the belt wheel 41 via the belt 42. Therefore, the non-selected overlock stitching mechanism is not driven under the condition of selection of the lock stitching mechanism.

As mentioned above the stitching mechanism is switched when the sewing machine is stopped, and the flywheel 60 is operated only when the rotation is restrained, and the switch lever 5 is made rotatable via the releasing shaft 20 and the safety lever 17. Therefore, even if a user tries to rotate the switch dial 4 during driving one of the stitching mechanisms, the switch lever 5 will not be rotated. Thus the safety is ensured. Further, the stitching mechanism is switched by the manual operation of the flywheel 60 to the switching phase, and switching the switch dial 4 when the sewing machine is stopped. Thus it is possible to avoid risks associated with conventional sewing machines which occur when the main shaft of the non-selected stitch forming mechanism is rotated less than one rotation. A shock could occur to the mechanism at switching, or the upper thread may slip in the non-selected stitch forming mechanism.

The switching from the lock stitching mechanism to the overlock stitching mechanism is made in that the flywheel 60 is rotated by the manual operation to the switching phase and is pushed in the axial direction, and the switching dial 4 is rotated to switch the indication line from LOCK STITCH to OVERLOCK STITCH. In such a manner, the overlock stitching is selected as shown in FIGS. 2 and 3.

The stitching mechanism selected in the lock stitching mechanism or the overlock stitching mechanism may be rotated forwards or backwards by the manual operation, instead of the driving source, since the belt wheel bush 24 is fixed to the flywheel 60. Therefore, the selected mechanism can be adjusted during the stitching operation by the manual driving of the flywheel 60.

A further explanation will be made to thread winding operation. A lower thread bobbin (not shown) is set on a thread winding shaft 54, and when a thread winding arm 67 is pushed down as shown in FIG. 7, this arm 67 is moved down by action of the spring 56 together with a thread winding rubber disc 68, so that the rubber disc 68 contacts a knurled portion **32*c* of the belt wheel 32 to provide a condition as shown by the broken line in FIG. 7. Under this condition, the horn 67*b* is separated from an engaging portion 57*a* and the declutch arm 57 is rotated by the spring 59 around the stepped screw 55 to the clockwise direction, and a lower end portion 57*b* of the declutch arm 57 enters the moving locus of the projection 31*b*. When the motor is driven, the lower end portion 57*b* engages the projection 31*b*, and since the clutch lever 31 releases the roller 34, the belt wheel 32 is made idle with respect to the belt wheel bush 24, and the thread winding shaft 54 is rotated by the knurled portion 32*c* via the thread winding rubber disc 68. In such a manner the thread winding is carried out. The flywheel 60** and the selected stitching mechanism are at this time at rest. The non-selected stitching mechanism is also at rest.

When the position shown by the thread winding arm 67 is returned to the solid line in FIG. 7 after thread winding, the rubber disc 68 is separated from the knurling portion **32*c* of the belt wheel 32 to interrupt rotation of the thread winding arm 54, and at the same time the horn 67*b* of the thread winding arm 67 rotates the declutch arm 57 around the stepped screw 58 to the counterclockwise direction in FIG. 8 and returns it to the condition shown by the solid line in the same. Since the lower end portion 57*b* of the declutch arm 57 becomes disengaged from the moving locus of the projection 31*b* of the clutch lever 31, the clutch lever 31 returns the collar 34 to the initial condition. Accordingly, the collar 34 again transmits thereby the driving force to the belt wheel bush 24 from the belt wheel 32**.

In the present invention, the engagement between the belt wheel bush 24 and the ratchet pawls 45 and 51 which are the sliding plates, depend upon engagement between the pawls **51*a* and 45*a* with respect to the ratchet gears 24*e* and 24*f* of the belt wheel bush 24. In the other manner, the ratchet gear 24*e* may be substituted for the groove 24*e*' as shown with an example of the lock stitching side in FIG. 9, and the pawl 51*a* may be substituted for the projection 51*a*' which is engageable with the groove 24*e*'. In FIG. 9, the numeral 51' is an engaging pawl of a sliding plate, and the other numerals designate the same parts or the same portions as explained with respect to FIG. 8**.

Furthermore, in the present invention the stitching mechanism is switched by pushing the flywheel 60 in the axial direction at the switching phase of the flywheel 60, but the switching may be also effected by pulling the flywheel 60 in the opposite direction.

With reference to FIGS. 10–12, it is seen that the flywheel 70 is rotated until the phase where the groove **70*b* formed in the flange 70*a* meets the pin 6*a*' defined on the machine frame 6' and when the flywheel 70 is drawn to the axial direction against a spring 71, a shaft 72 is moved rightwards in FIG. 10 via the flange portion 70*a*, and a lever 74 pivoted to the machine frame 6' by a stepped screw 73 pushes the bent portion 17*b* of the safety lever 17, thereby to raise the end portion 17*a* of the safety lever 17 away from the groove 5*c* of the switch lever 5. The operation hereafter may be carried out by the same order as the switching operation. The numerals having not been referred to designate the same parts or portions as in FIG. 8**.

Thus, according to the present invention, the above mentioned objects of the invention in the introduction part may be attained.

It will be understood that each of the elements described above, or two or more together, may also find a useful application in other types of double-function sewing machines differing from the types described above.

While the invention has been illustrated and described as embodied in a double-function sewing machine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A switching device of a double-function sewing machine of the type including a machine frame, a flywheel having a shaft, a lock stitch forming mechanism having a main shaft and an overlock stitch forming mechanism, the device comprising a belt wheel bush which is notatable with respect to the machine frame and is driven by a driving source, said belt wheel bush having an end secured to the shaft of the flywheel; a ratchet guide member mounted on the main shaft of the lock stitch forming mechanism, said guide member being notatable with respect to the machine frame; a first sliding plate mounted on said ratchet guide member; a belt wheel for overlock stitching rotatably supported with respect to the machine frame and operatively connected to the overlock stitch forming mechanism; a second sliding plate mounted on said belt wheel; a switch lever which is operated from outside of the machine frame; and a pair of switching arms operatively connected to said switch lever and operated thereby such that said first sliding plate and said second sliding plate are alternatively held on said belt wheel bush for selecting the lock stitch forming mechanism or the overlock stitching forming mechanism.

2. The switching device as defined in claim 1, said switch lever having a shaft carrying a dial at an end thereof, said dial being positioned outside of the machine frame, the non-selected stitch forming mechanism being engaged in a direction of rotation of said switch lever by the respective switching arm at the time of releasing of the respective sliding plate of said stitch forming mechanism from said belt wheel bush.

3. The switching device as defined in claim 2, further including a belt wheel for lock stitching connectable to the driving source and mounted on said belt wheel bush.

4. The switching device as defined in claim 3, wherein said first sliding plate and said second sliding plate are ratchet pawls, said belt wheel bush including ratchet gears at opposite sides thereof, said ratchet pawls being engageable with the respective ratchet gears.

5. The switching device as defined in claim 4, further including means on the flywheel for operating said switch lever.

6. The switching device as defined in claim 4, wherein said switching arms are spring-biased to the machine frame.

* * * * *